US007422216B1

(12) United States Patent
Underhill

(10) Patent No.: US 7,422,216 B1
(45) Date of Patent: Sep. 9, 2008

(54) TARGET DEVICE

(76) Inventor: Clinton James Underhill, P.O. Box 501, Oroville, CA (US) 95965

( * ) Notice: Subject to any disclaimer, the term of this patent is extended or adjusted under 35 U.S.C. 154(b) by 0 days.

(21) Appl. No.: 11/682,008

(22) Filed: Mar. 5, 2007

Related U.S. Application Data

(60) Provisional application No. 60/784,625, filed on Mar. 6, 2006.

(51) Int. Cl.
*F41J 7/04* (2006.01)

(52) U.S. Cl. ..... 273/392

(58) Field of Classification Search ..... 273/390–392, 273/406, 407
See application file for complete search history.

(56) References Cited

U.S. PATENT DOCUMENTS 1,267,722 A * 5/1918 Walter ..... 273/391
1,348,540 A * 8/1920 Briggs ..... 273/388
2,561,733 A * 7/1951 Foyst ..... 273/388
3,411,784 A * 11/1968 Lawrence ..... 273/388
4,550,918 A * 11/1985 Motsenbocker ..... 273/385
4,588,194 A * 5/1986 Steidle et al. ..... 273/391
4,949,980 A * 8/1990 Hoy ..... 273/391
5,263,722 A * 11/1993 Rosellen ..... 273/391
6,347,798 B1 * 2/2002 Quiring et al. ..... 273/391
6,896,267 B1 * 5/2005 Le Anna ..... 273/391
2005/0098954 A1 * 5/2005 Stutz ..... 273/390

* cited by examiner

*Primary Examiner*—Mark S Graham

(57) ABSTRACT

A mechanical target device utilizing a plurality of targets, a stand, a rod, reset plate and reset lever provides practice or competition opportunities for markspersons. The target device mechanically allows the first contacted target to activate a rod that locks the other target in place. The reset plate must then be contacted to reset the first contacted target to its original position.

12 Claims, 3 Drawing Sheets

TARGET DEVICE

CROSS REFERENCE TO RELATED APPLICATIONS

This application claims priority from U.S. Provisional Patent Application No. 60/784,625 filed Mar. 6, 2006. The contents of U.S. Provisional Patent Application No. 60/784,625 are incorporated herein by reference.

FIELD OF THE INVENTION

The present invention relates to practice or competition target devices.

BACKGROUND OF THE INVENTION

Markspersons have long used targets for honing their marksmanship skills and competing with other markspersons. While target devices exist, there is a need for a mechanical target device that is accurate, easy to transport and set up and requires no power source (other than the force of a projectile) to operate.

The lone marksperson utilizes a target to hone his/her skills and has a need for a field target that can be easily activated and reset from a remote location. These same needs are shared by markspersons participating in a target competition. In addition, competition participants need a device that accurately records the first target hit and thus limits the opportunity for error and dispute.

SUMMARY OF THE INVENTION

The target device disclosed herein provides a mechanism that can be easily transported and set up for target practice and/or competition. The target device is activated solely by the force of projectiles contacting the targets. No internal, connected or coupled power source is necessary, thus eliminating the need for power supplies.

Initially the targets of this device are set in a substantially upright, idle position. When a first target is hit with enough force to displace it from its upright position, this device mechanically locks the second target in its upright position. Thus if the second target is later hit, it cannot be dislodged from its upright position.

A unique reset plate or target is utilized to reset the target. The marksperson must make contact with the reset plate which rotates and engages a reset lever which returns the first hit target to its upright, idle position. The target device is then ready for practice or competition once again.

BRIEF DESCRIPTION OF DRAWINGS

The character of the invention, however, may be best understood by reference to one of its structural forms, as illustrated by the accompanying drawings, in which.

DETAILED DESCRIPTION OF THE DRAWINGS

Figure 1:
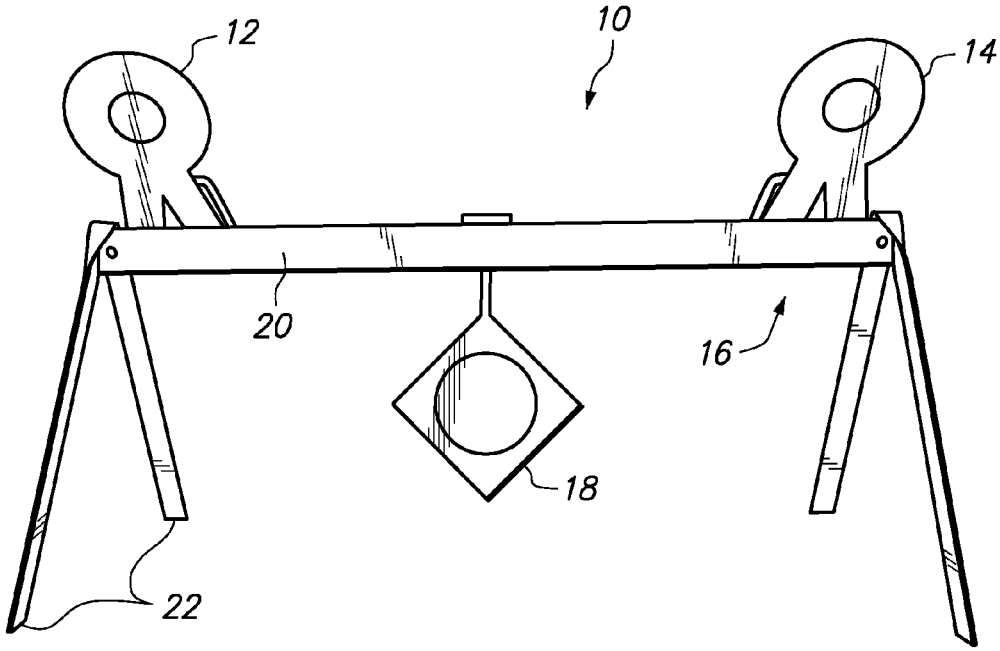
FIG. 1 is a perspective view front view of the target device.

Referring to FIG. 1, which shows the general features of a preferred embodiment of the invention, the target device 10 is comprised of targets 12, 14, a stand 16 and a reset plate/target 18. The stand in FIG. 1 is further comprised of a cross beam 20 and support legs 22. The target stand is shown in idle position, i.e., the targets are set for target practice and/or for competition.

Figure 2:
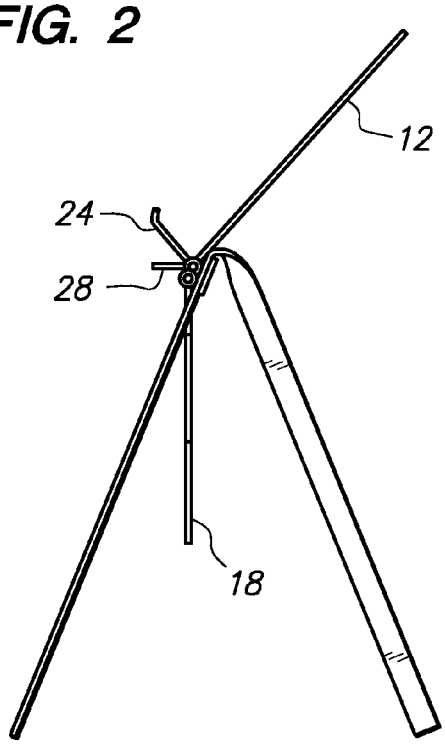
FIG. 2 is a right side view of the target device.

FIG. 2 shows a side view of the target stand with the targets in ready or idle position. From this view the forward-leaning position of the target(s) 12, 14 is evident. The reset plate/target 18 is suspended substantially orthogonal to the ground. The angled lever(s) 24, 26 and U-shaped reset lever 28 are affixed to the connecting rod (not shown). The angle between the angled lever(s) and the reset lever is less than 90 degrees as illustrated.

Figure 3:
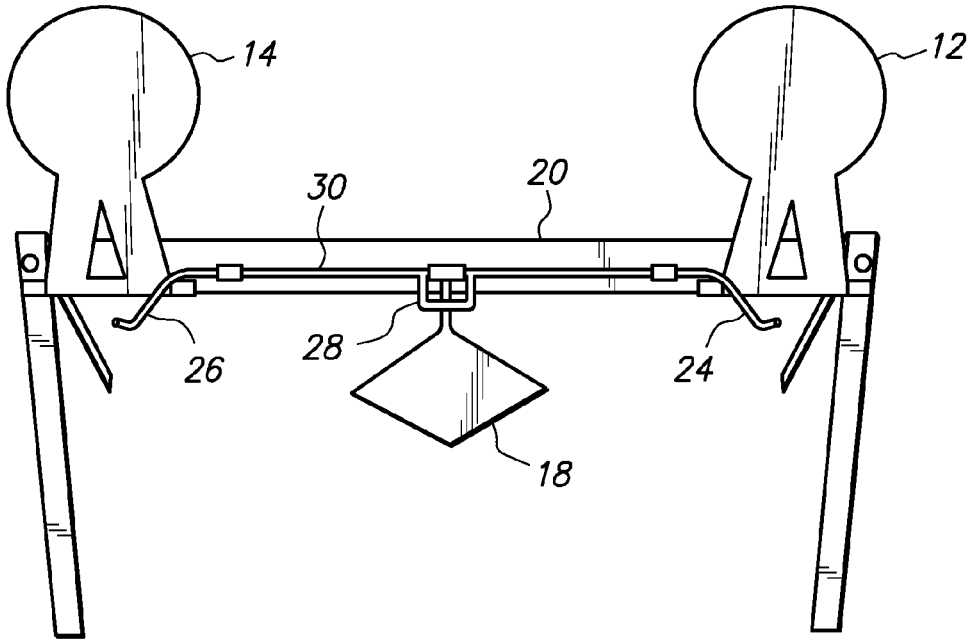
FIG. 3 is a perspective back view of the target device.

FIG. 3 shows the various components of the target device as seen from a rear perspective view. A first target 12 and a second target 14 are rotatably attached to the cross-beam 20 of the target stand. Rod 30 is also rotatably attached to the cross-beam. Angle levers 24, 26 are on each end of the rod and thus connected. Reset plate 18 is rotatably attached to the connecting rod 30 between two limbs of a U-shaped reset lever 28.

Figure 4:
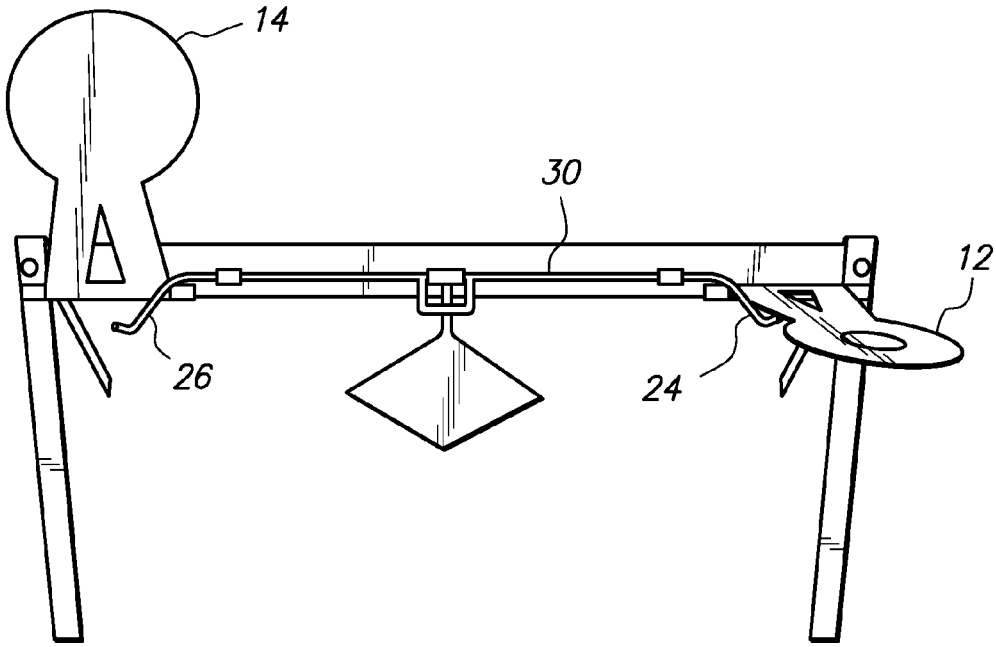
FIG. 4 is a perspective back view of the target device with one target in the down position.

FIG. 4 shows the section of the target device with one target 12 in the "down" position. When a target is hit, it falls backwards and the side of the target base contacts the adjacent angled lever 24 at the end of the connecting rod 30. The connecting rod is laterally displaced towards the upright target 14. The other angled lever 26 of the connecting rod contacts the base of the upright target 14 and prevents it from moving from its substantially upright position.

Figure 5:
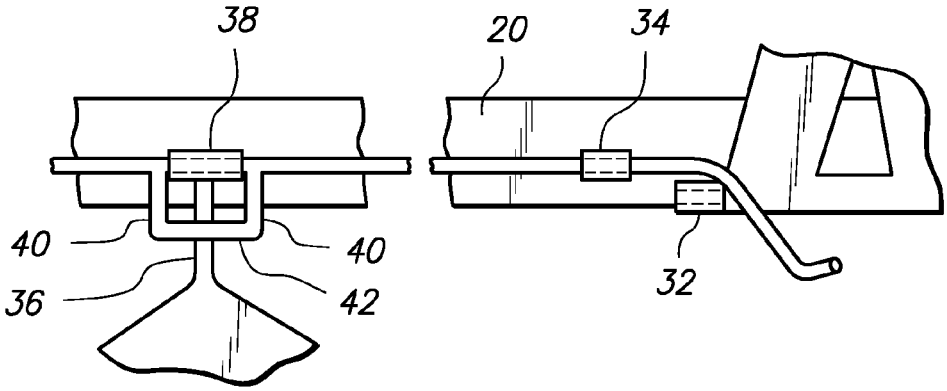
FIG. 5 shows a back view close-up of the target device components prior to activation of a target.
Figure 6:
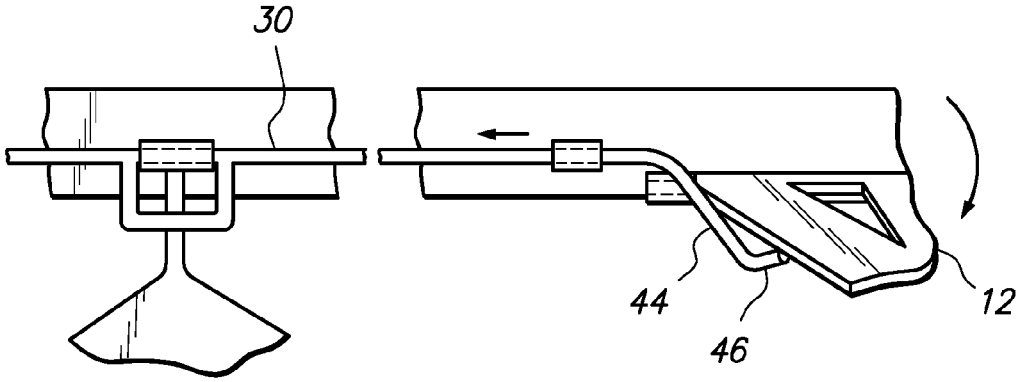
FIG. 6 shows the target device components upon target activation.
Figure 7:
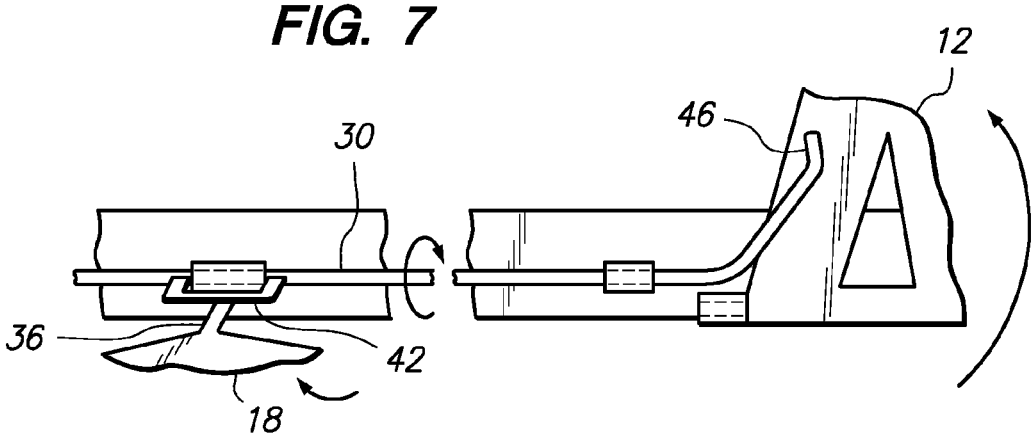
FIG. 7 shows the target device components as the target is reset to ready or idle position.

The target displacement and reset positions are illustrated in FIGS. 5-7. In FIG. 5, the targets are in a substantially upright position. Note that the targets are rotatably attached to the cross beam 20 via supports 32. The connecting rod is also rotatably attached to the cross beam via supports 34. The reset plate is attached to an arm 36 which in turn is rotatably attached to the connecting rod via a rotational support or sleeve 38. The sleeve 38 is positioned on the connecting rod between two arms 40 of the reset lever. The reset lever is comprised of two limbs 40 and a cross piece 42.

The angled lever is comprised of a first section 44 and a second section 46 as shown in FIG. 6. The angled levers on each end of the connecting rod are approximately mirror images of each other. When a target 12 is hit and "downed" as illustrated in FIG. 6, the side of the target base contacts the first section 44 of the connecting rod and displaces the rod laterally, thus locking in the other target (not shown). The second section 46 of the angled lever rests against the back of the target when the target is in the downed position.

To reset the target, a marksperson must hit the reset plate/target. When the reset plate 18 is hit it initially rotates about the connecting rod as seen in FIG. 7. When the arm 36 of the reset plate contacts the cross piece 42 of the reset lever, it forces rotation of the connecting rod also. The second section 46 of the angled lever then pushes the target 12 back into an upright position. The target(s) remains in an upright (slightly forward) position and the reset plate drops back to its reset idle position as shown in FIG. 1.

CONCLUSIONS, OTHER EMBODIMENTS, AND SCOPE

As shown and described, an embodiment of the present invention provides a competition device that can be utilized by markspersons in practice or competition. Projectiles can be dispensed from any suitable apparatus or simply thrown at the targets. The target device allows remote activation and resetting of the target by contact with a projectile. There is no need for internal or external power other than the energy supplied by a projectile making contact with a target.

The stand that supports and stabilizes the target device can encompass many forms. Embodiments can include stand legs. The stand legs illustrated herein are strategically oriented to minimize the ricochet effect of stray projectiles. Other stand configurations could provide similar results.

The stand embodiment shown can easily sit upon the surface of a floor or ground and provide a support base. Another embodiment would utilize stand legs that could more easily penetrate the ground. Still another could have cross braces tying the legs together at ground level. Many variations of support or leg components could serve as an adequate base for the target device disclosed herein.

There could be several variations of the targets themselves. The center of gravity of the targets however should have proper placement. Proper center of gravity placement will allow the target in maintain an idle position before contact and, after contact, allow the target to stay in a "downed" position until it is reset. Proper center of gravity of the reset plate allows it to rotate upon being hit, activate the reset lever to return a target to its upright position, and return itself to its idle reset position.

It is contemplated that mechanical, electrical and/or computerized scoring devices could be attached to the device described herein to provide additional record keeping capabilities. However, the mechanical nature of the target and reset mechanism would remain intact.

The targets illustrated herein have angled bases which contact and essentially slide along the angle lever laterally displacing the connecting rod. Other configurations of the base and angled lever may be utilized to accomplish a lateral displacement of the connecting rod.

Other embodiments of the invention will be apparent to those skilled in the art from a consideration of the specification or practice of the invention disclosed herein. It should be evident that this disclosure is by way of example and that various changes may be made by adding, modifying, or eliminating details without departing from the fair scope of the teaching contained in this disclosure. The invention is therefore not limited to particular details of this disclosure except to the extent that the following claims are necessarily so limited. Thus it is intended that the specification and examples be considered as illustrative only, with the true scope and spirit of the invention being indicated by the following claims.

What is claimed is:

1. A target device comprising:

a target stand;

a plurality of targets rotatably affixed to said target stand;

a rod rotatably affixed to said target stand between said plurality of targets, said rod laterally moveable between said plurality of targets;

a reset plate rotatably affixed to said rod;

a reset lever affixed to said rod, and an angled lever affixed to each end of said rod, said angled lever further comprising a first section for contacting the side area of an adjacent target and a second section for contacting the back area of an adjacent target.

2. The target device of claim 1 wherein said target stand further comprises a cross beam and a plurality of support legs.

3. The target device of claim 1 wherein said cross beam is rectangular in shape.

4. The target device of claim 3 wherein said cross beam is oriented to the ground at between zero and 90 degrees.

5. The target device of claim 4 wherein said cross beam is oriented to the ground at between 45 and 85 degrees to hold said plurality of targets in a stable position.

6. The target device of claim 1 wherein said reset lever is U-shaped and further comprises two reset limbs and a cross piece.

7. The target device of claim 6 wherein said U-shaped reset lever in affixed to said rod at said two reset limbs.

8. The target device of claim 7 wherein said reset plate further comprises a reset arm.

9. The target device of claim 8 wherein said reset plate is rotatably affixed to said rod at said reset arm.

10. The target device of claim 9 wherein the lateral movement of said reset plate is constrained along said rod between said reset limbs.

11. The target device of claim 1 wherein said target stand further comprises a cross beam.

12. A method of utilizing the target device of claim 1 comprising:

contacting a first target with a projectile to move said target from a substantially upright position into a non-upright position and constrain other targets to a substantially upright position; and contacting a reset plate with a projectile to mechanically reset said target into a substantially upright position.

* * * * *